United States Patent [19]

Farnsworth

[11] Patent Number: 4,910,438

[45] Date of Patent: Mar. 20, 1990

[54] WIDE BAND, HIGH EFFICIENCY SIMMER POWER SUPPLY FOR A LASER FLASHLAMP

[75] Inventor: Robert P. Farnsworth, Los Angeles, Calif.

[73] Assignee: Hughes Aircraft Company, Los Angeles, Calif.

[21] Appl. No.: 810,399

[22] Filed: Dec. 17, 1985

[51] Int. Cl.[4] ..... H05B 41/16

[52] U.S. Cl. ..... 315/241 P; 315/307; 315/174; 315/241 S

[58] Field of Search ..... 315/113, 174, 178, 241 R, 315/243, 246, 232, 224, 208, 225, 237, 307, 324, 241 P, 241 S

[56] References Cited

U.S. PATENT DOCUMENTS

| | | | |
|---|---|---|---|
| 3,962,601 | 6/1976 | Wrzesinski | 315/243 |
| 4,005,337 | 1/1977 | Rabe | 315/241 R |
| 4,253,048 | 2/1981 | Osako | 315/307 |
| 4,276,497 | 6/1981 | Burbeck et al. | 315/244 |
| 4,316,125 | 2/1982 | Noguchi | 315/241 R |
| 4,398,129 | 8/1983 | Logan | 315/208 |
| 4,469,991 | 9/1984 | McAllister | 315/241 R |
| 4,489,415 | 12/1984 | Jones, Jr. | 315/209 R |
| 4,623,824 | 11/1986 | Scolari et al. | 315/241 R |
| 4,623,929 | 11/1986 | Johnson et al. | 315/101 |

*Primary Examiner*—James J. Groody
*Assistant Examiner*—Mark R. Powell
*Attorney, Agent, or Firm*—William J. Streeter; Wanda K. Denson-Low

[57] ABSTRACT

Methods and apparatus are disclosed for supplying and controlling simmer current to a flashlamp 28. A direct current-to-direct current converter including a transformer 12, full-wave bridge rectifier 24, and first and second switching means 20 and 22 produces an output which is always higher than the maximum required by the flashlamp 28 at its lowest simmer current. The converter (12, 20, 22, 24) is coupled to flashlamp 28 through an inductor 26. The current I(s) through a pair of inductors 26, 30 is sensed by a lamp current sensing circuit 34 which turns the converter on or off, respectively, when a preselected minimum or maximum value is reached. The converter transformer 12 is maintained in its operating range by the switching of two devices such as power FET's 20, 22 so that one or the other of the two halves of the primary winding 14 is used alternately. The initial ionization of flashlamp 28 is provided by simmer trigger circuit 38. A transformer primary current sensing circuit 40 controls the toggling action which alternates the operation of switching means 20 and 22. The advantages of this method for supplying and controlling flashlamp simmer current include fast current response, extended flashlamp life, simplicity of design, high efficiency, and the avoidance of saturation and synchronization problems.

17 Claims, 4 Drawing Sheets

Fig. 1.
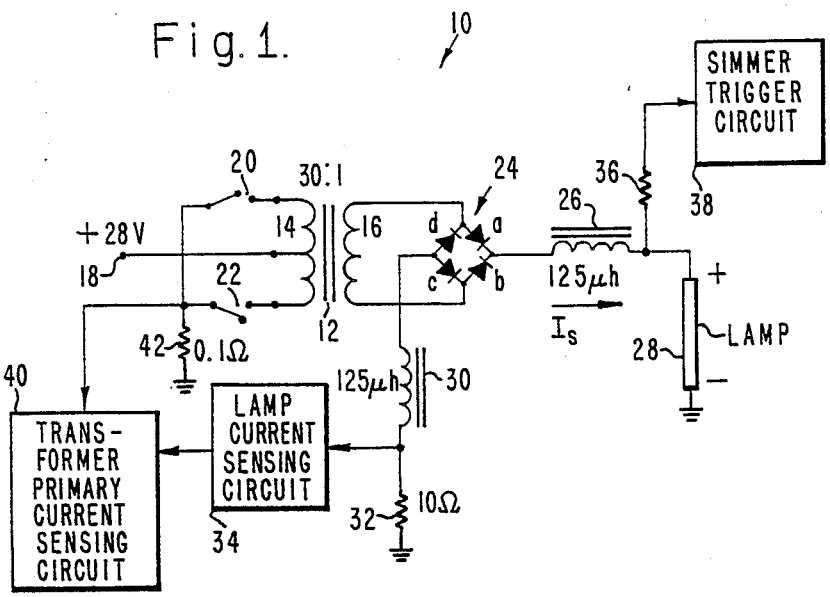
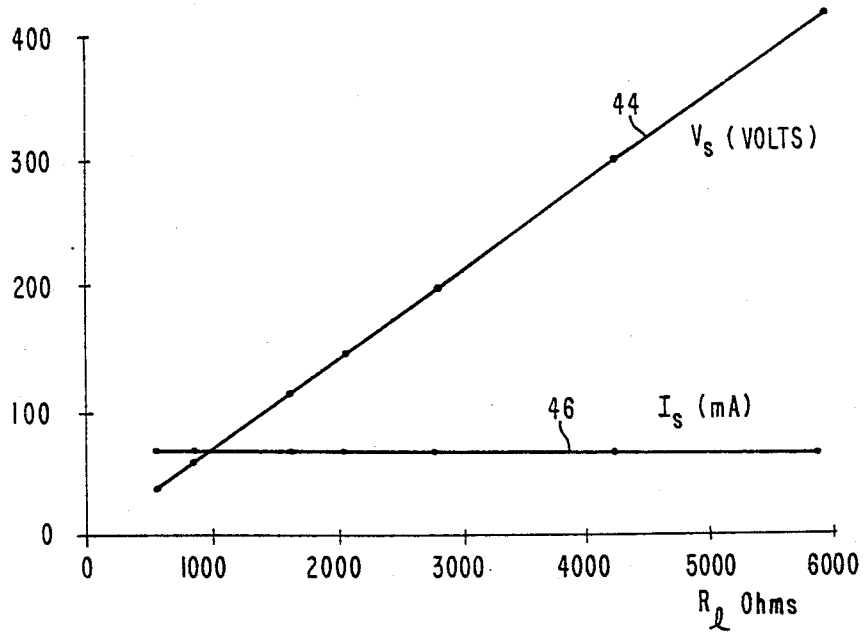
Fig. 2.

(a) Vs in VOLTS
200
100
0
48
0 10 20 30 40
t μSEC
(b) Is
100
50
0
50
0 10 20 30 40
t μSEC
(c) Rℓ in Ω
2K
1K
0
52
0 10 20 30 40
t μSEC
(d) δ
0.08
0.04
0
54
0 10 20 30 40
t μSEC

WIDE BAND, HIGH EFFICIENCY SIMMER POWER SUPPLY FOR A LASER FLASHLAMP

BACKGROUND OF THE INVENTION.

U.S. Government Rights.

The United States Government has certain rights in this invention, which was developed under Contract No. DAAK10-81-C-0093 awarded by the United States Army.

FIELD OF THE INVENTION.

The present invention relates to laser pumping power supplies, and, more particularly, to means for providing and controlling simmer current to a gaseous discharge device such as a flashlamp associated with laser optical pumping.

DESCRIPTION OF THE TECHNOLOGY.

Laser gain media receive excitation energy from a variety of flashtube or flashlamp devices which initiates the process of light amplification. A flashlamp is capable of producing light from energy stored in a continuously ready supply. This light is generally composed of blackbody radiation which includes light energy having frequencies that coincide with the frequencies of transition between the ground states and the pumping bands of the laser medium. It is this portion of flashlamp output which stimulates the emission of radiation by inducing a population inversion within the gain medium.

It is advantageous to maintain a simmer current through the flashlamp at a comparatively low power level compared to that needed for full firing of the flashlamp in order to improve output energy stability from the laser and to increase flashlamp life. Enhancing flashlamp life is a critically important design objective, since systems which incorporate devices similar to the present invention are expected to function without fail over a million to ten million times. The maintenance of a steady simmer current enables a pulsed arc to be formed in the flashlamp in an almost instantaneous response to a pulsed power source. As a result, the operational life of the flashlamp is increased because of reduced physical shock from the high-energy pumping pulses, reduced devitrification of the flashlamp envelope, and minimization of electrode sputtering and evaporation.

The importance of keeping a flashlamp in a simmer condition so that it is ready to fire at the time the main pumping energy is applied to the gain medium is well known to those persons ordinarily skilled in the art. Several earlier devices pertain to this general area of technological enterprise. Among these devices, a few inventions have attempted to solve the problem of placing a flashlamp in a simmer condition.

In U.S. Pat. No. 4,398,129, Logan describes a flashlamp drive circuit using an unsaturated transistor as a current mode switch to periodically subject a partially ionized gaseous laser excitation flashlamp to a stable, rectangular pulse of current from an incomplete discharge of an energy storage capacitor. The pulse interval is set by a monostable multivibrator, and the pulse amplitude is controlled by a feedback signal provided by a tap on an emitter resistor. The circuit drives a flashlamp to provide a square wave current flashlamp discharge. After the lamp has been placed in a partially ionized state by an ignition voltage pulse from an external source, a transistor in the circuit, held below saturation in an active, common-emitter configuration, cyclically switches the amplitude of current between two modes—a simmer condition maintaining partial ionization and a total ionization pumping condition. The Logan patent is primarily concerned with the utilization of an active device in series with a flashlamp to control flashlamp current and the laser pumping process. The circuitry disclosed in this patent does not teach methods or apparatus for actively controlling the simmer current. Logan explains that the simmer condition developed by his device fails if any load is imposed which severly limits the bandwidth of the simmer state segment of his lamp driver circuit. The Logan invention appears to be more concerned with using an active device to control the shape, duration, and timing of the laser output pulse during full, high current discharge than with the regulation of simmer current.

In U.S. Pat. No. 4,035,691, Altman et al. disclose a pulsed laser excitation source with light energy output which is principally in the 3600 to 4300 Angstrom spectral region. An envelope of material that is substantially transparent to radiation within the desired spectral region contains an amount of xenon gas which produces at least one atmosphere of pressure in its unheated state. The envelope also contains an amount of mercury which develops a vapor pressure of not less than one atmosphere when the envelope is heated to its operative temperature. When spaced electrodes within this sealed envelope are energized by an external source of pulsed electrical power, an electrical arc or discharge is generated. In one embodiment of the Altman invention, the direct current simmer current in the light source is maintained within the range of 15 to 25 amperes in order to facilitate the breakdown of the xenon gas and thus insure pulsed arcing across the spaced electrodes in virtually instantaneous response to the pulsed power source. A preferred embodiment of this invention may include a suitable direct current power source as well to expedite and facilitate the breakdown of the xenon gas.

U.S. Pat. No. 4,005,333—Nichols describes apparatus for increasing the output efficiency of an optically coupled Nd:YAG (Neodymium: Yttrium-Aluminum-Garnet) laser by turning on a flashlamp slightly at a predetermined interval of time before the laser is fully energized. This invention utilizes a pseudosimmer concept in which a small quantity of pump energy is applied to the flashlamp just before the main discharge of energy is released to stimulate the laser gain medium. Nichols asserts that this method of triggering results in a larger ionic path diameter at the time of the main energy release to the flashlamp. Current flow from the main energy supply through the flashlamp is controlled by a silicon controlled rectifier. Nichols' simmer pulse network is characterized by a capacitor that stores energy, which, when allowed to flow, is conducted serially through a saturable inductor, an isolating diode, and the flashlamp.

Dere et al. disclose an optical cavity for a flashlamp pumped dye laser in U.S. Pat. No. 3,967,212 which includes a pumping cavity, a birefringent filter, and a plurality of frequency doubling crystals. Within the pumping cavity, the flashlamp is cooled by forced air convection and is operated with a direct current simmer current. The inventors of this device claim that the application of the direct current arc or simmer current to the flashlamp increases the operational lifetime of the flashlamp. Dere et al. also assert that their technique reduces the physical shock of high energy pumping pulses endured by the flashlamp, diminishes envelope devitrification, and minimizes electrode sputtering and evaporation. Although the Dere patent mentions the use of a simmer power supply to increase the operating life of a flashlamp, the inventors do not teach or suggest apparatus or methods for producing simmer current as claimed in the present invention.

U.S. Pat. No. 4,267,497 contains a description of a power supply for a laser flashtube or lamp such as a continuous wave arc lamp. Burbeck et al. describe a high frequency switch for providing a pulse train output from a direct current supply. Before a pulse train output is imposed across the flashtube or lamp, the pulse width of the signal is modulated and a portion of the high frequency ripple in the signal is removed by a filter. The modulated pulse train output may be raised to a direct current level in order to supply simmer current to the flashtube or lamp. The high frequency switch may consist of at least one transistor or thyristor. The filter may be an arrangement of inductors and capacitors.

This Burbeck invention comprises a switching type regulator which supplies a controlled current to a flashlamp. This prior device employs a sensing technique which is more concerned with the current through the lamp and the generation of a constant low ripple lamp current, as opposed to sensing the voltage across the flashlamp. The level of simmer current which is needed to maintain conduction in the Burbeck flashlamp is relatively high since the simmer current is generated from a relatively low impedance source.

None of the inventions described above responds quickly to changes in the flashlamp voltage, regulates simmer current using a d.c.-to-d.c. converter in a single control loop, maintains the flashlamp simmer current between preselected, desirable upper and lower levels, and avoids saturation and synchronization difficulties encountered by many prior devices. None of these prior methods or apparatus provides an effective and comprehensive solution which addresses all of the complex aspects of this simmer current problem. Such a solution to this problem would satisfy a long felt need experienced by the laser industry for over two decades. A truly practical and reliable means for producing an efficacious simmer current that would extend laser flashlamp life substantially would constitute a major advancement in the optoelectronics field. Manufacturers of laser devices could employ such an innovative design to produce lasers which would be capable of instantaneous firing at full power on demand. Such an invention would ideally be suited to operate in cooperation with a wide variety of coherent radiation systems and would perform consistently and reliably over a wide range of operating conditions and system applications.

SUMMARY OF THE INVENTION

The present invention provides an efficacious, practical, cost-effective, compact, and straightforward solution to the problem of generating, regulating, and controlling a suitable simmer current which will enhance the performance and operating lifetime of laser flashlamps and similar gas discharge lamps. This invention utilizes a d.c.-to-d.c. converter to generate an output voltage which is higher than the maximum voltage required by the flashlamp at the lowest simmer current. This converter is connected to the flashlamp by an inductor. The current through this inductor is sensed by an actuator circuit which turns the d.c.-to-d.c. converter on when a minimum inductor current is sensed, and turns the converter off when a maximum current flows through the inductor. The simmer current is automatically, rapidly, and reliably maintained between preselected limits. This automatic regulation is accomplished without producing deleterious current spikes which are generated by transformer saturation. By maintaining a continuous simmer condition, the Farnsworth flashlamp simmer power supply insures that the flashlamp is constantly in a state of full power readiness. The lamp remains on for extended periods because the simmer condition preserves a minute filament of conducting ions between its internal electrodes. Even after the flashlamp operating characteristics have been degraded over time, the simmer circuit still operates, since it is capable of constant and substantially instantaneous adjustment to the changing flashlamp current. This enormous dynamic range and stability of operation allows this innovative device to be used with a broad variety of laser systems under greatly disparate environmental conditions. The present invention controls simmer current without the saturation and synchronization problems which plague prior devices that incorporate interacting control loop designs. While previous contrivances have attempted to provide simmer current by sensing average current through a flashtube and responding slowly to correct an imbalance, the present invention supplies a remedy which is instantaneous. The present invention also constitutes an achievement in simplification of previously complex electronic design. The switching components used in the invention claimed below represent an evolution beyond the multiple switching loops and all their concomitant problems which have been utilized in the past. The Farnsworth simmer current invention further includes a circuit design which is substantially immune from noise and Joule heating losses which greatly debilitate flashlamp performance.

It is, therefore, an object of the present invention to substantially increase the operating life of a flashlamp or gas discharge device by providing an automatic, precisely controlled, regulated simmer current which maintains the flashlamp or gas discharge device in a continuously but only slightly active or simmer condition in order to provide instantaneous, full power capacity on demand. By precluding the necessity of repeatedly having to reinitiate the full discharge arc, the continuous low power arc totally eliminates the need to repetitively start the flashlamp from a completely cold condition.

It is a further object of the invention to provide a simmer current system which can respond to changes in flashlamp current in extremely short time periods.

It is also an object of this invention to ensure that the flashlamp current never exceeds the preselected upper limit nor drops below the preselected lower limit, so long as the lamp requirements are between zero and the maximum voltage of the supply.

Another object of the present invention is to control the simmer current by employing a regulating direct current-to-direct current converter in a circuit arrangement that comprises a single control loop, so that synchronization and other difficulties associated with previous designs are avoided.

Still another object of the invention is to avoid transient drops in flashlamp current in the event that the d.c.-to-d.c. converter transformer should experience saturation.

It is a further object of the invention to provide simmer power to a flashlamp more efficiently than in previous designs by minimizing resistive heat losses in control circuits.

Yet another object of this Farnsworth invention is to supply well regulated flashlamp simmer current that is relatively immune from the deleterious consequences of noise or voltage fluctuation within the lamp.

An appreciation of other aims and objects of the present invention and a more complete and comprehensive understanding of this invention may be achieved by studying the following description of a preferred embodiment and by referring to the accompanying drawings.

BRIEF DESCRIPTION OF THE DRAWINGS

FIG. 1 is a schematic diagram that depicts essential elements of the present invention including the flashlamp simmer current supply and control means.

FIG. 2 illustrates regulation curves for the Farnsworth simmer power supply for driving fixed resistor loads.

DESCRIPTION OF A PREFERRED EMBODIMENT

Figure 3:
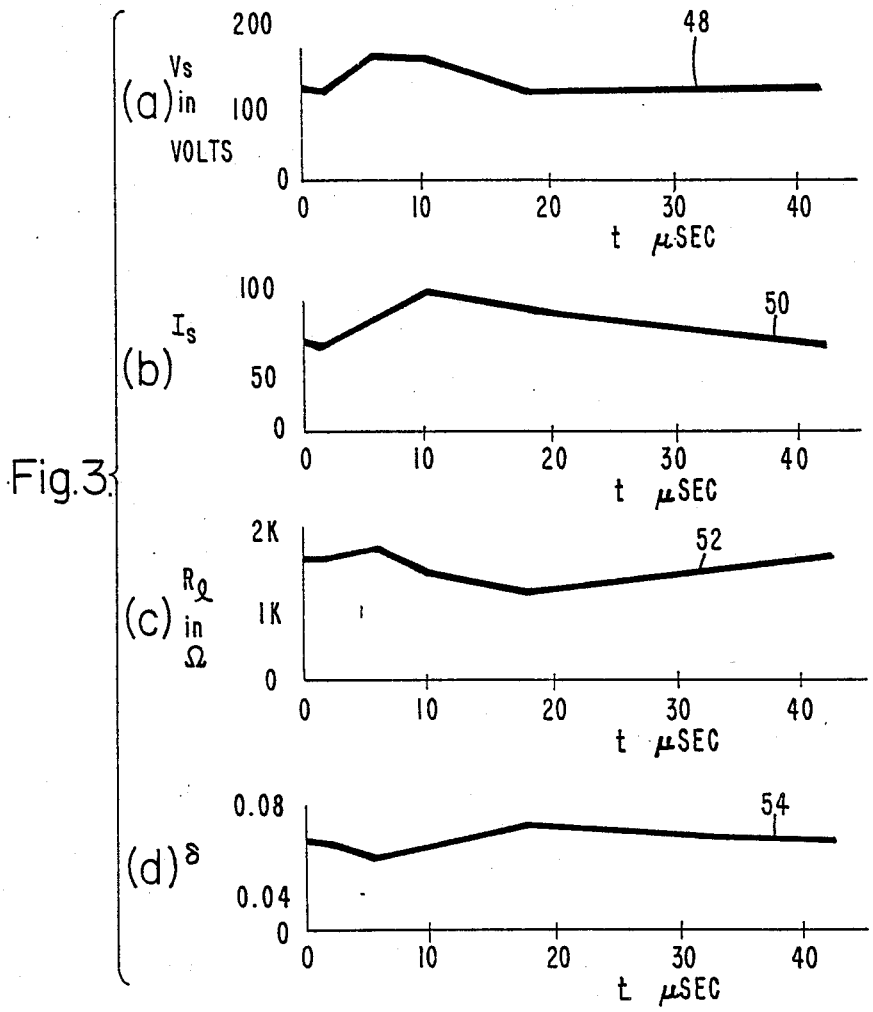
FIGS. 3(*a*), (*b*), (*c*), and (*d*) depict traces which reveal the details of one regulation cycle of the present invention over forty microseconds.

FIG. 1 depicts a diagram of the simmer current power supply 10 in abbreviated schematic form. A direct current-to-direct current converter transformer 12 includes a primary winding 14, a secondary winding 16, and a direct current input center tap 18. In this preferred embodiment, the primary to secondary winding ratio is thirty to one and the voltage introduced at input tap 18 is twenty-eight volts. The primary winding 14 is coupled to first switching means 20 and second switching means 22 illustrated schematically as on/off switches. In the preferred embodiment, first and second switching means are field effect transistors (FETs). The output of secondary 16 is connected in parallel to full wave rectifying bridge 24 which includes four diodes 24*a,b,c,d*. The rectifying bridge 24 is coupled in series to the anode of the flashlamp 28 through flashlamp coupling inductor 26. The best mode of the present invention employs a 125 microhenry coil for inductor 26. The current through inductor 26 is shown as I(s). The cathode or negative terminal of the flashlamp is connected to ground.

A lamp current sensing circuit 34 is connected to rectifier 24 through a lamp current sensing circuit coupling inductor 30. This inductor is also a 125 microhenry coil in the preferred embodiment. A lamp current sensing circuit coupling resistor 32 which has a resistance of ten ohms connects inductor 30 to ground.

A simmer trigger circuit 38 is also coupled in series to the output of rectifier 24 through inductor 26 and simmer trigger circuit coupling resistor 36 for the purpose of initiating triggering of lamp 28 when the voltage across the lamp exceeds a preset level. The preferred value for coupling resistor 36 is 301 kilohms. A transformer primary current sensing circuit 40 is connected to a coupling resistor 42. The coupling resistor 42 having a resistance of 0.1 ohms connects first switching means 20 and second switching means 22 to ground.

One of the essential aspects of the invention is the operation of the d.c.-to-d.c. converter transformer 12, which generates a higher output voltage than the maximum required by flashlamp 28 at the lowest simmer current. Since the voltage of the converter transformer 12 is higher than the lamp voltage, the current in coupling inductor 26 increases at a rate determined by the difference in source and load voltages and the inductance value of coil 26 and coil 30.

If the simmer current in flashlamp 28 is too low, one of the switching means 20, 22 will be activated and the voltage at the output of converter transformer 12 will increase and quickly exceed the required flashlamp voltage. Full wave rectifying bridge 24 impresses this excess voltage across the twin inductors 26 and 30. The polarity of this impressed voltage is such that the current through inductors 26 and 30 will increase with time. Since flashlamp 28 is connected in series with these coils, the flashlamp current I(s) increases accordingly. If the current I(s) is too large or becomes too large, switching means 20, 22 are turned off and the current through flashlamp 28 is maintained only by the inductive action of coils 26 and 30. This results in a voltage drop across inductors 26 and 30 which produces a diminution of flashlamp current over time.

Lamp current sensing circuit 34 is a conventional logic circuit which monitors the load current I(s) with the help of inductor 30 and resistor 32. The elements and design of this current sensing subcircuit are well known to persons ordinarily skilled in the electronics arts. When I(s) reaches a preselected upper limit, lamp current sensing circuit 34 turns off converter transformer 12 by turning off one of the two switching means 20, 22. This change in output from converter transformer 12 immediately causes the flashlamp current to diminish at a rate determined by the lamp voltage and the inductance values of coils 26 and 30. When the current I(s) falls to its preselected low limit, converter transformer 12 is activated again and the lamp current I(s) immediately increases. Each time the d.c.-d.c. converter 12 is turned on, switching means 20, 22 are toggled so that their operation alternates. This alternate operation keeps the converter transformer 12 within its operating range, although both switching means are turned off during some intervals of operation. If d.c.-d.c. converter transformer 12 reaches a saturation condition before the upper limit of lamp current is achieved, the d.c.-d.c. converter shuts off. It remains in an inactive condition until the lamp current I(s) reaches the lower limit, and then the opposite switching means of the converter is turned back on.

When converter transformer 12 is saturated, the increased primary current is sensed by resistor 42 connected to transformer primary current sensing circuit 40 and switching means 20, 22. If the two switching means 20, 22 are field effect transistors, resistor 42 is connected in series with their common sources. If the primary current sensing signal exceeds some threshold value of a current sense comparator 80 (not shown in FIG. 1) within the transformer primary current sensing circuit 40, a signal is generated which turns off both switching means 20, 22. The current sense comparator 82 (not shown in FIG. 1) within the lamp current sensing circuit 34 then holds both switching means 20, 22 in an off condition until the flashlamp current I(s) reaches its lower limit. Since saturation of converter transformer 12 only occurs when the switching means 20, 22 have been on for almost the full interval of time needed to reachs full flashlamp current I(s), the time the two switching means are held in an off condition will be nearly as long, as if the deactivation of the switching means 20, 22 had been caused by reaching the preselected upper limit for I(s). Saturation normally occurs only for slight imbalances in the winding resistances of the two halves of the primary winding and differences in the resistances of the switching means when they are in an on condition. In the event that the lamp 28 fails in an open condition, the primary sense circuit 40 will function to toggle the switching means 20, 22 at a relatively lower frequency as the transformer 12 is allowed to safely alternate between its two saturation limits. Under simmering conditions, the frequency of this switching is, therefore, approximately the same for switching due to current sensing in the lamp current sensing circuit 34 or in transformer primary current sensing circuit 40. The switching frequency is determined by the values of the circuit components and by the dynamic behavior of flashlamp 28. The switching frequency may be reduced by increasing the value of inductance of the coils 26 and 30.

The toggling action which alternates the operation of switching means 20, 22 is controlled by a flip-flop 86 circuit (not shown in FIG. 1) within transformer primary current sensing circuit 40. As the two switching means 20 and 22 are alternately activated, the flux in converter transformer 12 varies back and forth over its unsaturated range. As the flux cycles, voltage of alternating polarity is supplied to transformer secondary 16.

Figure 7:
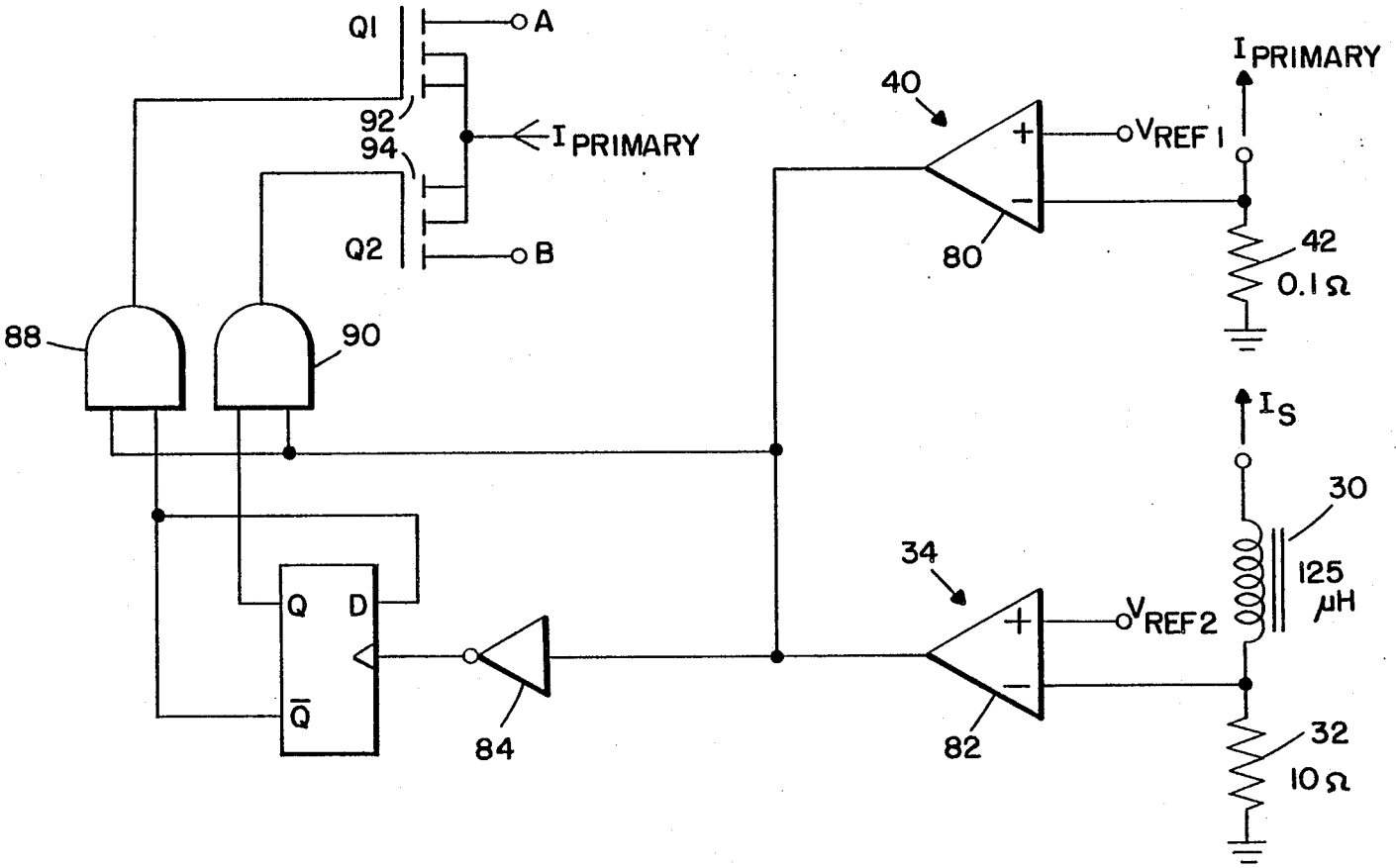
FIG. 7 is a schematic diagram showing the transformer primary current sensing circuit and the lamp current sensing circuit.

The foregoing aspects of the present invention may be seen in more detail in FIG. 7. Transformer primary current sensing circuit 40 is comprised of a voltage comparator 80 having a first voltage reference $V_{REF1}$ coupled to a noninverting input thereof and an inverting input coupled to the top of resistor 42. The magnitude of $V_{REF1}$ is predetermined to be equal to the magnitude of the voltage appearing across resistor 42 due to the transformer primary current $I_{PRIMARY}$ when an overcurrent condition exists in transformer primary 14. When such an overcurrent condition occurs, the output of comparator 40 will be low, disabling gates 88 and 90 and turning off switching means 20 and 22, which in FIG. 7 are shown as FETs 92 and 94. When the transformer primary 14 overcurrent condition is removed, the voltage appearing at the inverting input of comparator 80 will be less than $V_{REF1}$, causing the output of comparator 80 to go high, reenabling gates 88 and 90 if lamp current sensing circuit 34 is not then sensing an overcurrent condition of $I_s$.

Lamp current sensing circuit 34 is similarly comprised of a voltage comparator 82 which is operable for comparing the voltage across resister 32, due to $I_s$, against a second voltage reference $V_{REF2}$. $V_{REF2}$ has a magnitude which corresponds to an $I_s$ overcurrent condition. If comparator 82 detects such an overcurrent condition, the output will be driven low. The output of comparator 82 is coupled to the output of comparator 80 such that when either is low gates 88 and 90 are disabled, thereby turning off FETs 92 and 94.

The outputs of comparators 80 and 82 are also coupled to the input of inverter 84 such that when either is driven low the output of inverter 84 is driven high, thereby clocking, or toggling, flip-flop 86. Flip-flop 86 has a Q output coupled to gate 90 and a Q-NOT output coupled to gate 88 such that either FET 94 or FET 92, respectively, is turned on when no overcurrent condition is present. The Q-NOT output is further coupled to the D input of flip-flop 86 such that the Q and Q-NOT outputs are alternately driven high when flip-flop 86 is clocked by inverter 84.

During the initial period of operation of the simmer power supply 10, the conduction of flashlamp 28 is started by a simmer trigger circuit 38. This subcircuit simply provides initial ionization of flashlamp 28, allowing the flow of simmer current which maintains the flashlamp in a continuously ready condition. The components within circuit 38 and its design and operation are well known to persons ordinarily skilled in the electronics arts.

FIG. 2 shows regulation curves 44 and 46 for driving fixed resistor loads. The regulator voltage V(s) is plotted in curve 44 in volts versus the resistance of the lamp in ohms. Curve 46 depicts current through the lamp I(s).

A single cycle of the regulator voltage V(s), current with a flashlamp load I(s), lamp resistance R(1), and relative diameter of the flashlamp simmer conducting path d~ are presented in FIG. 3. A comparison of this data for the present invention with the performance of previous devices suggests the superb ability of the Farnsworth circuity to smooth out flashlamp current variations and restrict them to a much narrower region. Since the present invention does not lock up and suffer from the synchronization problems which plague prior devices, the flashlamp in the invention claimed below operates at a dynamic resistance level and arc diameter that precludes the snuff-out problem observed in earlier power supplies.

Figure 4:
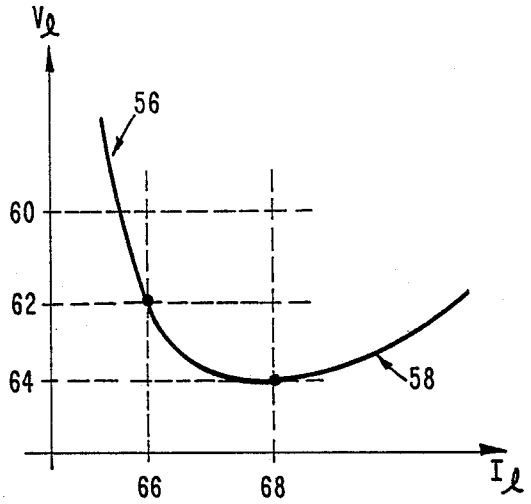
FIG. 4 is a graph of the voltage V(1) across a typical flashlamp versus the current through the flashlamp I(1) showing the various limiting values for the simmer current, simmer voltage, and supply voltage.

FIG. 4 illustrates the dynamic range of the simmer power supply. The single graph plots the flashlamp voltage V(1) against flashlamp current I(1) across the entire range of operation of the present invention. The output voltage of transformer 12 is indicated by horizontal dashed line 60. The intermediate horizontal dashed line 62 represents the maximum lamp voltage at the minimum desired simmer current. The lowest horizontal dashed line 64 marks the minimum lamp voltage at the maximum desired simmer current. The range of simmer current in one preferred embodiment is indicated by minimum current 66 and maximum current 68. At low current region 56 of the voltage versus current graph, the impedance (R) of the flashlamp 28 is negative ten kilohms or greater. Low current region 56 is bounded by the lower limit of simmer current range indicated by dashed vertical line 66. A flashlamp represents a load whose behavior is nonlinear. When operated at low current its resistance may become negative. In order to stabilize the operation of the flashlamp in this negative impedance region, the flashlamp is driven by a positive impedance larger than the lamp's negative impedance. High current portion 58 of the voltage versus current curve is bounded by the upper limit of the range of the simmer current 68. At this region of operation, the impedance (R) of the flashlamp is on the order of one or two ohms.

Figure 5:
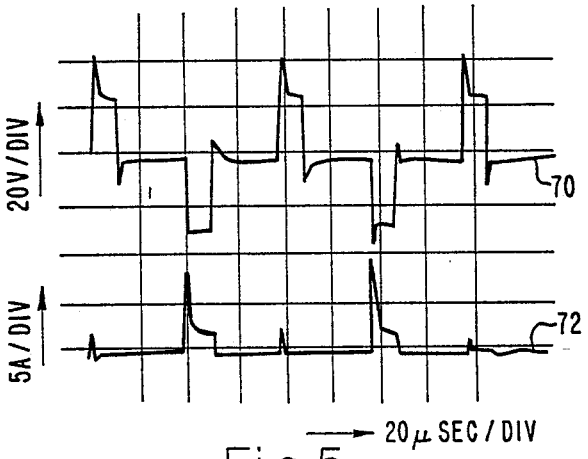
FIG. 5 is a dual oscilloscope trace showing a typical example of FET drain voltage (top) and drain current (bottom).

FIG. 5 reveals experimental data obtained during a test of the present invention. When a pair of field effect transistors are employed as first and second switching means 20 and 22 in the primary winding 14 of d.c.-to-d.c. converter transformer 12, the drain voltage and drain current appear as illustrated in curves 70 and 72 respectively. Voltage curve 70 is measured against a grid which represents twenty volts per division along the abscissa. Current curve 72 is measured at five amperes per vertical division. Both graphs 70 and 72 are plotted against a time scale along the ordinate that is measured at twenty microseconds per division.

Figure 6:
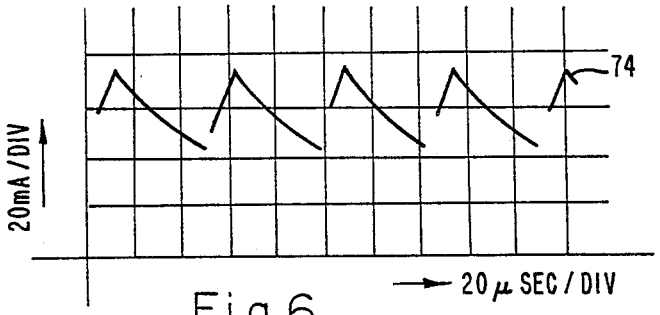
FIG. 6 is another oscilloscope trace revealing the cyclical rise and fall of the flashlamp current which results from the simmer power condition created by the present invention.

FIG. 6 contains a graph generated during a laboratory test of the Farnsworth simmer power supply. The flashlamp current is shown by curve 74 against a scale of twenty milliamperes per division along the y-axis and a time scale of twenty microseconds per division along the x-axis.

Because the present invention includes a low value sensing resistor to sense the flashlamp current, the Farnsworth simmer current invention further includes a circuit design which is substantially immune from noise and Joule heating losses which would greatly debilitate flashlamp performance.

In the preferred embodiment, the strike voltage across the lamp, measured from cathode to anode, is approximately at least 800 volts at the moment triggering is initiated. The nominal simmer output voltage across the lamp takes on some steady state value, usually between 100 and 200 volts as required by lamp characteristics. The simmer current is nominally around 60 milliamperes with a maximum short term deviation cycle of ±30 percent. The simmer current is optimally capable of building up immediately after the flashlamp is triggered. The lamp voltage is also optimally capable of following the rapid drop in lamp resistance while the simmer arc is forming. During steady state operation, the voltage follows short term variations in lamp resistance caused by simmer supply internal oscillations. Current regulation is controlled in the secondary of the transformer. High and low values of current through the series inductor I(s) are sensed directly and used to open and close the switching field effect transistors in the primary of the transformer. One advantage of this embodiment is that there is no overlap in FET conduction, since they are either both open, when I(s) is too high and decreasing, or one is closed when I(s) is too low and increasing. The circuit is arrange to automatically alternate the FET that is closed when the current needs to be higher. When one FET is closed and I(s) reaches its preselected limit, then that FET is opened. After I(s) falls to its minimum preselected limit, the other FET is closed and the cycle is repeated as often as is necessary. Another advantage of the preferred embodiment is that if, during a cycle the transformer were to saturate due to an uneven match of the switching FET's or due to an excessively high simmer voltage requirement, a second sense in the primary winding of the transformer will switch the activated or conducting FET off and the other half of the winding will be energized. Yet another important feature of this version of this innovative invention is that before the simmer current is initiated, the lamp appears to have an enormous resistance, 3 billion ohms, for example, from the perspective of the simmer current circuit. At this time before the simmer condition is imposed, the full voltage of about 800 volts is imposed on this virtual open circuit. This is accomplished more easily with the present design because the full secondary is driven by each half of the primary. Still another advantage which may be realized by incorporating this important invention into laser radiation devices is the economy of components required, since the Farnsworth simmer power supply requires no filter capacitors across the flashlamp. This improvement leads to much faster responses to variations in the lamp current as compared to previous devices.

In order for the present simmer power supply circuit to work properly, the product of input voltage to the transformer at input tap 18 and the step-up turns ration of the transformer 12 must be greater than the required flashlamp voltage. Persons ordinarily skilled in the electronics arts will readily appreciate this design requirement and would be able to accommodate this operation condition by providing an appropriate transformer for use with the Farnsworth invention claimed below.

The Farnsworth simmer power supply continuously maintains the flashlamp current I(s) between the preselected upper and lower limits. It provides ideal simmer operation independent of flashlamp characteristics. This important invention constitutes a major step forward in the laser and electro-optronic arts.

Although the present invention has been described in detail with reference to a particular preferred embodiment, persons possessing ordinary skill in the art to which this invention pertains will appreciate that various modifications and enhancements may be made without departing from the spirit and scope of the invention.

What is claimed is:

1. A method of continuously maintaining a simmer current in a gaseous discharge device in order to insure that said gaseous discharge device is always held in a state of full power readiness including the steps of:

generating a gaseous discharge device input voltage which is always greater than a maximum gaseous discharge device voltage which corresponds to a lowest gaseous discharge device simmer current, the simmer current flowing through a first inductance and through a second inductance, a first terminal of each of the first and second inductances being coupled together, a second terminal of the second inductance being coupled to the gaseous discharge device;

coupling the generated input voltage to the first terminals of the first and second inductances;

sensing a magnitude of the simmer current at a second terminal of the first inductance; and adjusting the gaseous discharge device input voltage in response to the magnitude of the simmer current so that the simmer current cycles continuously within a preselected range of values.

2. A method of providing a simmer current to a flashlamp including the steps of:

applying a simmer current to the flashlamp through a first inductance and through a second inductance, a first terminal of each of the first and the second inductances being serially coupled together, a second terminal of the second inductance being coupled to the gaseous discharge device;

sensing the simmer current within the flashlamp with a flashlamp current sensing circuit coupled to the flashlamp at a second terminal of the first inductance;

comparing the sensed simmer current to an upper current limit and to a lower current limit stored in a flashlamp current sensing circuit which is coupled to a direct current-to-direct current converter transformer, an output of the transformer being coupled to the first terminals of the first and the second inductances;

increasing the simmer current if the simmer current is equal to the lower limit by energizing the direct current-to-direct current converter transformer, the converter transformer providing an increase in output voltage which, in turn, increases the simmer current; and decreasing the simmer current if the simmer current is equal to the upper limit by de-energizing the converter transformer, which, in turn, decreases the simmer current in order to maintain the simmer current within a predetermined range.

3. Apparatus for providing and controlling simmer current to a gaseous discharge device comprising:

a first inductance and a second inductance serially coupled together at a first terminal of each of said first and said second inductances, said second inductance further being coupled to a gaseous discharge device such that said discharge receives a simmer current though said first and said second inductances;

a current sensing means for sensing the simmer current in said gaseous discharge device, said current sensing means having an input coupled to a second terminal of said first inductance;

power means having an output coupled to said first terminals of said first and second inductances for supplying said simmer current to said gaseous discharge device;

first and second switching means coupled to said power means for selectively energizing said power means in order to provide said simmer current within a preselected current range; and control means having a first input coupled to an output of said current sensing means and an output coupled to said first and second switching means for regulating the alternation of operation of said first and second switching means.

4. Apparatus as claimed in claim 3 in which:

said power means is a direct current-to-direct current converter including a transformer which further includes a primary winding and a secondary winding, and which is further coupled to a full-wave bridge rectifier.

5. Apparatus as claimed in claim 3 in which:

said first and second switching means are field effect transistors.

6. Apparatus as claimed in claim 3 in which:

said gaseous discharge device is a flashlamp for a laser.

7. Apparatus as claimed in claim 4 in which:

said control means comprises a second input coupled to an output of a transformer primary current sensing circuit.

8. Apparatus as claimed in claim 4 in which:

said direct current-to-direct current converter transformer has a ratio of primary windings to secondary windings which produces a higher output voltage than a maximum voltage required by said gaseous discharge device at a preselected low limit of said simmer current.

9. Apparatus as claimed in claim 4 in which:

said first and said second switching means are each coupled to said primary winding of said transformer, and wherein:

said current sensing means de-energizes said primary winding of said direct current-to-direct current converter transformer by de-activating at least one of said first and second switching means if said gaseous discharge device current exceeds a preselected maximum current.

10. Apparatus as claimed in claim 4 in which:

said first and said second switching means are each coupled to said primary winding of said transformer, and wherein:

said current sensing means energizes said primary winding of said direct current-to-direct current converter transformer by activating one of said first and second switching means in an alternating sequence if said gaseous discharge device current falls below a preselected minimum current.

11. A simmer power supply for a flashlamp comprising:

a direct current-to-direct current converter transformer which includes:

a primary winding, a secondary winding, a center input tap, a first FET switching device coupled to said primary winding, a second FET switching device coupled to said primary winding, and a full-wave bridge rectifier;

said direct current-to-direct current converter transformer being coupled to said flashlamp through a flashlamp coupling inductor;

a flashlamp current sensing circuit coupled to said direct current-to-direct current converter transformer through a lamp current sensing circuit coupling inductor;

a transformer primary current sensing circuit coupled to said primary winding of said direct current-to-direct current converter transformer;

a transformer primary current sensing circuit coupling resistor connected to said transformer primary current sensing circuit and to ground; and a simmer trigger circuit connected to said flashlamp through a simmer trigger circuit coupling resistor.

12. Apparatus for maintaining a simmer current in a gaseous discharge device, comprising:

means for generating a gaseous discharge device input voltage having a magnitude which is greater than a maximum gaseous discharge device voltage which corresponds to a lowest gaseous discharge device simmer current, the simmer current flowing through a first inductance and through a second inductance, a first terminal of each of the first and second inductances being coupled together and a second terminal of the second inductance being coupled to the gaseous discharge device;

means for coupling the generated input voltage to the first terminals of the first and second inductances;

means for sensing a magnitude of the simmer current at a second terminal of the first inductance; and means for regulating the magnitude of the gaseous discharge device input voltage in response to the sensed magnitude of the simmer current such that the magnitude of the simmer current is maintained within a preselected range of values.

13. Apparatus as defined in claim 12 wherein said means for generating comprises:

a DC-to-DC converter transformer having a primary winding and a secondary winding, the secondary winding having a full-wave bridge rectifier coupled thereacross, the first terminals of each of the first and second inductances being coupled together through the full-wave bridge rectifier.

14. Apparatus as defined in claim 13 wherein said transformer primary winding has a first and a second FET device coupled to a first and a second end, respectively, of the primary winding and wherein the primary winding further has a tap coupled to a source of DC voltage.

15. Apparatus as defined in claim 14 wherein said regulating means comprises means coupled to a gate of each of the FET devices for alternately energizing and deenergizing the FET devices in response to the sensed magnitude of the simmer current.

16. Apparatus as defined in claim 15 wherein said regulating means further comprises primary current sense means having an input coupled to the primary winding for sensing a magnitude of the primary winding current which exceeds a predetermined maximum magnitude, the primary current sense means further having an output coupled to the gate of each of the FET devices for deenergizing both of the FET devices when the predetermined maximum magnitude is sensed.

17. Apparatus as defined in claim 12 wherein each of the first and second inductances has an inductance value of approximately 125 microhenries.

* * * * *